US005137276A

United States Patent [19]

Monneret

[11] Patent Number: 5,137,276

[45] Date of Patent: Aug. 11, 1992

[54] PLAYER FOR TABLE FOOTBALL MACHINE

[75] Inventor: Alain Monneret, Montain-Voiteur, France

[73] Assignee: Monneret Jouets, Lons Le Saunier, France

[21] Appl. No.: 750,318

[22] Filed: Aug. 27, 1991

[30] Foreign Application Priority Data

Aug. 31, 1990 [FR] France ..... 90 11054

[51] Int. Cl.[5] ..... A63F 7/06

[52] U.S. Cl. ..... 273/85 D

[58] Field of Search ..... 273/85 R, 85 C, 85 D, 273/129 R, 119 R

[56] References Cited

U.S. PATENT DOCUMENTS

| | | | |
|---|---|---|---|
| D. 217,372 | 4/1970 | Patterson | 273/85 C X |
| 3,920,244 | 11/1975 | Kaiser | 273/85 D |
| 4,046,378 | 9/1977 | Furr | 273/85 D |
| 4,076,244 | 2/1978 | Peppard | 273/85 D |
| 4,078,797 | 3/1978 | Bergee | 273/85 D |
| 4,127,269 | 11/1978 | Rest | 273/85 D |
| 4,138,110 | 2/1979 | Hendrickson . | |

FOREIGN PATENT DOCUMENTS

| | | | |
|---|---|---|---|
| 497144 | 11/1950 | Belgium | 273/85 D |
| 852821 | 7/1977 | Belgium . | |
| 2057981 | 8/1971 | Fed. Rep. of Germany | 273/85 D |
| 980203 | 5/1951 | France | 273/58 D |
| 985312 | 6/1951 | France | 273/85 D |
| 991037 | 9/1951 | France | 273/85 C |
| 1034971 | 8/1953 | France | 273/85 D |
| 75147 | 3/1961 | France | 273/85 C |
| 2072774 | 9/1971 | France . | |
| 479682 | 4/1953 | Italy | 273/85 D |
| 500168 | 11/1954 | Italy | 273/85 D |
| 518959 | 3/1955 | Italy | 273/85 D |
| 532808 | 9/1955 | Italy | 273/85 C |

*Primary Examiner*—Theatrice Brown
*Assistant Examiner*—Sebastiano Passaniti
*Attorney, Agent, or Firm*—Oliff & Berridge

[57] ABSTRACT

A player for a table football machine has two elements, one of which includes the torso and the head and the other of which includes the lower body and the legs of the player, each of the elements being of a length slightly greater than a part of the player it represents to allow for some overlapping upon assembly. The elements are arranged in order to be assembled to one another by partial nesting and wedging and/or snapping, totally enclosing a rod on which the elements are fixed. One of these elements has a male assembly end and the other has a female assembly end. Each player is rigidly connected in rotation and axially with the rod on which the player is mounted. Each element of a player has, at its end for assemblying with the other, a notch whose substantially semicylindrical base has a radius substantially equal to the outer radius of the rod. The element which possesses a male assembly end has, in the semicylindrical base of its notch, a radial stud. The rod intended to support this player has, on a segment intended to receive this player, an aperture whose perimeter corresponds to the cross-section of the stud and which is intended to receive the stud to connect the player and the rod in rotation and translation.

6 Claims, 2 Drawing Sheets

PLAYER FOR TABLE FOOTBALL MACHINE

BACKGROUND OF THE INVENTION

The present invention relates to a player for table football machine, that is to say a figurine which has to be fixed to a horizontal rod mounted transversely, free in rotation and axially sliding, over the rectangular base of a box structure representing a football pitch. The rods, each of which carries one or more players of a single team and which are generally eight in number, are distributed in two equal series of four, all the rods of a single series carrying the players of a single team. Moreover, these bars are equipped, at one of their ends, with a maneuvering handle enabling them to be pivoted freely and to be slid axially to the end of their maximum axial travel.

In current table football machines, the players are usually fixed in a nonremovable manner onto the rods and their distribution cannot be altered: a single player representing the goalkeeper is fixed to the rear rod, two players representing the left and right backs are fixed to the rod located immediately in front of the above-mentioned rod, five players representing the "mid-field" players are fixed to the central rod and, finally, three players representing the "forwards" are fixed to the front rod.

A table football game consists in maneuvering these rods so as to strike a ball which serves as a football with a view to propelling it into the opposing goal mouth while preventing it penetrating into one's own goal mouth.

It is readily appreciated that the players must be fixed to the rods supporting them very rigidly since the torques to which they are subjected can reach very high values, particularly when their feet strike radially against the ball and jamming then occurs. Moreover, the players at the side suffer, at the end of axial travel of the rod, in their direction, and above all if this travel is effected rapidly and suddenly, very violent lateral shocks, despite the presence of dampers supported by the longitudinal walls of the box structure and coaxial with the bearings of the rods.

DESCRIPTION OF THE PRIOR ART

In point of fact, in current table football machines, the players are generally fixed to the rods by wedging, gluing or molding-on or screwing, which does not always fix them securely enough to enable them to withstand the abovementioned forces and shocks, or gives rise to too high a cost price.

Document P U.S. Pat. No. 4,138,110 discloses a table football game of the abovementioned type in which each player consists of two elements, one of which comprises the torso and the head and the other of which comprises the lower body and the legs, each of which is of a length slightly greater than the part of the player it represents and is arranged so as to be able to be assembled to the other part by partial nesting and wedging and/or snapping, totally enclosing the rod on which it is fixed, one of these elements having a male assembly end and the other having a female assembly end, and each element of a player having, at its end for assembly with the other, a notch whose substantially semicylindrical base has a radius which is substantially equal to that of a rod, while means are provided for connecting each player rigidly in rotation and in translation with the rod on which he is mounted.

In this table football game, the means for fixing the two elements of a player to the rod consist of a bolt passing radially through the rod and the overlapping parts of the two elements of this player.

Although the fixing, thus obtained, of the players to the rod supporting them is excellent, it does not, however, permit rapid and tool-free dismantling of a player, particularly in order to modify his position on the rod or, additionally, the form of his feet, between two games or even during play.

Moreover, this fixing method prevents the use of tubular rods which are axially movable on stationary spindles supporting their ends opposite those equipped with maneuvering handles, which means that these ends have to project beyond the frame of the machine, which is dangerous for the users.

SUMMARY OF THE INVENTION

The present invention aims to remedy these drawbacks by providing table football players capable of being fixed to the rods supporting them not only very securely but also in a manner such that they can be removed rapidly without the use of a tool being necessary and without this resulting in too high a cost.

To this end, that of the two elements of a player which possesses a male assembly end having, in the semicylindrical base of its notch, a radial stud, and the rod intended to support this player, has, on its segment intended to receive this player, an aperture whose perimeter corresponds to the cross-section of the abovementioned stud and which is intended to receive it to form therewith the means for connecting the player and the rod in rotation and in translation.

Thus, not only is a very solid fixing of the players to the rods supporting them obtained, but also this fixing is removable, which facilitates the changing of a player, particularly in the event of breakage of one of his elements or in order to change the forms thereof.

This arrangement also makes it possible to modify, at will, the arrangement of the players on the rods, since, in order to do so, it suffices to provide, on each rod, a number of player-fixing means equal to the maximum number of players which this rod is supposed to receive, according to the tactics adopted. It is possible, for example, to fix four players on the front rod supporting the "forwards" and only four players on the central rod supporting the "mid-field" players.

This arrangement further makes it possible to adopt specific players, that is to say those in which the feet have a front face inclined from top to bottom and from the rear to the front in order to permit the achievement of lobs or, additionally, inclined laterally to permit the achievement of center passes or of direct shots at goal by players at the sides.

Preferably, the element which has a male assembly end is that which comprises the lower body and the legs.

The base of the notch of each element forming a player advantageously has a cylindrical portion extending over a sector slightly greater than 180° such that the width of the opening of this notch is less than the diameter of the rod on which this player is mounted. This arrangement has the effect of improving the fixing of each piece by snapping on the rod.

BRIEF DESCRIPTION OF THE DRAWINGS

In any case, the invention will be satisfactorily understood with the aid of the following description and with reference to the appended schematic drawing representing, by way of nonlimiting example, an embodiment of this table football player.

DESCRIPTION OF THE PREFERRED EMBODIMENT

Figure 1:
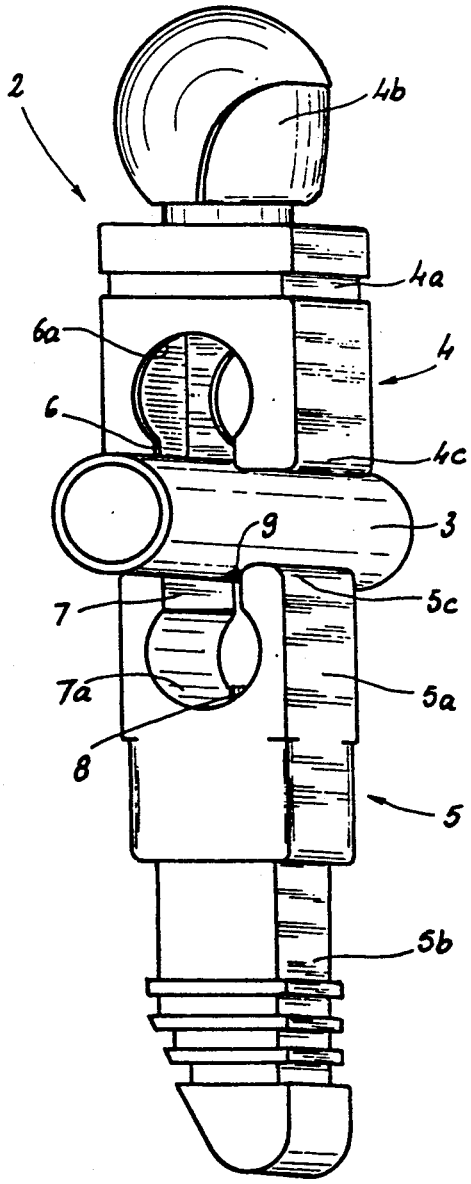
FIG. 1 is an exploded perspective view thereof before mounting on a rod.

The drawing shows a table football player 2 intended to be mounted and fixed, both in translation and in rotation, to a tubular rod 3 which is itself transversely supported by the longitudinal walls of a rectangular box structure (not shown in the drawing) and whose base is intended to represent a football pitch.

This player 2 consists of two elements, namely an upper element 4 comprising the torso 4*a* and the head 4*b*, and a lower element 5, comprising the lower body 5*a*, the legs and the feet 5*b* of the player 2.

Each of these elements 4 and 5 is intended to be assembled to the other element by partial nesting, wedging and/or snapping. To this end, each of these elements 4 and 5 has an assembly end 4*c* and 5*c*, respectively, which is its end facing the other element and the male 5*c* of which is intended to be engaged in the other female 4*c*. Moreover, the assembly of the two elements 4 and 5 must enable them to totally enclose the rod 3.

To this end, each of the elements 4 and 5 has, at its assembly end, an opening-out notch, respectively 6 and 7, the base of which, respectively 6*a* and 7*a*, has a partially cylindrical form with a radius substantially equal to that r of the rod 3.

As shown in the drawing, the cylindrical bases 6*a* and 7*a* of the notches 6 and 7 of the elements 4 and 5 extend over a sector which is slightly greater than 180° such that the width l of their opening is slightly smaller than the outer radius r of the rod 3. The engagement of the two elements 4 and 5 on the rod 3 as far as the base of the notches 6 and 7 can thus be achieved only by virtue of the elasticity of their constituent material, this elasticity ensuring they are held by snapping on the rod 3.

Figure 2:
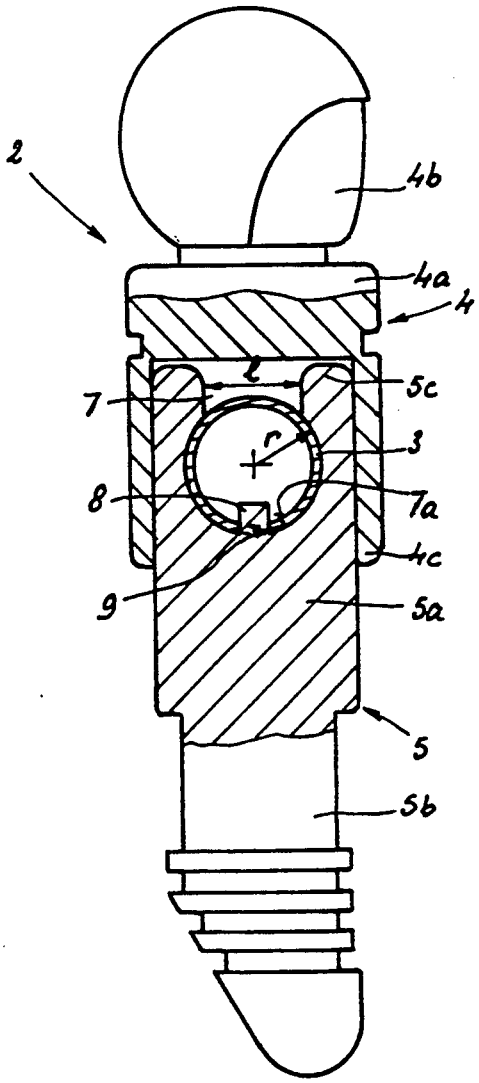
FIG. 2 is a vertical sectional view thereof according to a plane perpendicular to the axis of the support rod after mounting on this rod.

As shown more particularly in FIG. 2, the engagement of the upper element 4 on the rod 3 and on the lower element 5 has the effect of ensuring locking of the lower element since its male assembly end 5*c* is trapped inside the female assembly end 4*c* of the upper element 4. This arrangement is advantageous since, during a table football game, it is precisely the lower element 5 which suffers the highest stresses, since it is with the aid of their feet 5*b* that the players 2 strike the ball forming the football. It is, in fact, unnecessary for the upper element 4 to be locked in its assembly position as rigidly as the lower element 5 since it does not suffer any force or torque.

To ensure rigid connection both in rotation and in translation of the player 2 with the rod 3 supporting it, the notch base 7*a* of the lower element 5 carries, in its center, a radial stud 8, and the rod 3 has, on its segment on which the player 2 has to be fixed, an aperture 9 whose perimeter corresponds to the cross-section of the stud 8. The engagement of the stud 8 in the aperture 9, after assembly of the two element 4 and 5 of this player 2 on the rod 3, satisfactorily ensures a rigid connection, due to the obstacle, of this player on the rod 3.

Figure 3:
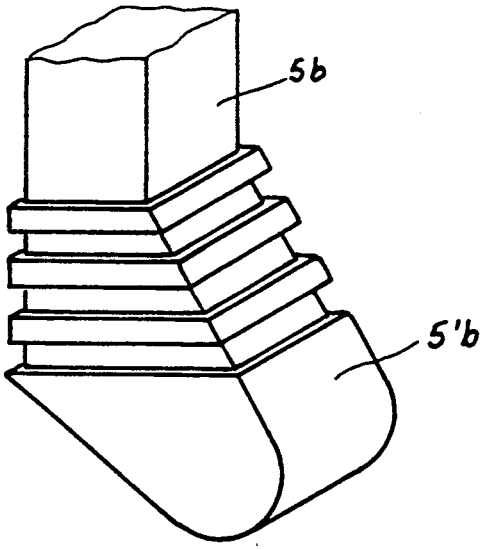
FIGS. 3 and 4 are partial perspective views showing various forms of producing the players' feet.
Figure 4:
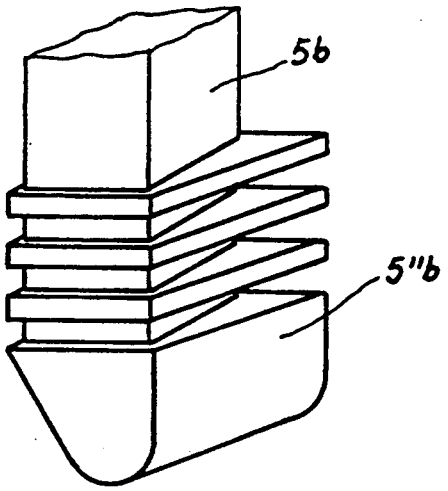

It should be noted that the assembly of the two elements 4 and 5 of the player 2 can be dismantled easily, which makes it possible to modify, at will, the locations of the players 2 on the rods 3, provided that the latter have the appropriate apertures 9, or makes it possible to replace, without any difficulty, a player 2 or an element 4, 5 of a damaged or broken player 2 or, additionally, to choose as lower element 5, among several, an element whose feet 5*b* have a particular form adapted to the position occupied by the player 2 in question on the football pitch. Thus, for example, it would be possible to provide, as shown in FIG. 3, for a player 2, feet 5*b* having a front face 5'b inclined from top to bottom and from the rear to the front in order to permit a lob against an opposing player. As illustrated in FIG. 4, a player could also be provided whose feet 5*b* have a front face 5''b which is vertical but inclined relative to the axis of the rod 3 supporting this player. When the slant of the front face 5''b is oriented towards the right, as is the case in FIG. 4, the player equipped therewith is thus capable of carrying out shots oriented towards the right, which perfectly suits a left wing whose role is to carry out center passes or, if appropriate, direct shots at goal.

Moreover, it should be noted that the presence of the studs 8 which do not pass totally through the tubular rods 3 in no way affects mounting, on fixed coaxial spindles, of the ends of the rods 3 which are not provided with a handle, such that these ends are always located inside the frame of the game and thus do not constitute a danger for the users.

As has been indicated above, the elements 4 and 5 of this player must have a certain elasticity and, for this reason, they are advantageously produced by molding or injection-molding in a suitable plastic.

I claim:

1. A player for a table football game of the type formed by a figurine fixed rigidly to a horizontal rod which is free in rotation and axially sliding, disposed transversely above a football game pitch, the rod including an aperture of predetermined cross-sectional dimensions, the pitch comprising a rectangular base of a box structure, said player comprising:

two elements, one of said two elements comprising a torso portion and a head portion, the other of said two elements comprising a lower body portion and a leg portion, one of said two elements having a male assembly end and the other of said two elements having a female assembly end, where upon assembly the male assembly end is fitted within the female assembly end;

a notch located at said female assembly end and a notch located at said male assembly end, each said notch having a substantially semicylindrical base of a diameter substantially equal to an outer diameter of the rod; and a stud located in said semicylindrical base of said male assembly end, wherein said player is installed on the rod by partially nesting and wedging said male assembly end and said female assembly end together, the rod being contained therebetween within said semicircular base of said female assembly end and said male assembly end, said two elements overlapping sufficient to fix said player onto the rod, said player being connected to the rod in rotation and in translation by engaging said stud of said male assembly end of said player within the aperture of the rod.

2. The player as claimed in claim 1, wherein the element which possesses said male assembly end also comprises the lower body portion and the leg portion.

3. The player as claimed in claim 1, wherein the base of the notch of each element forming a player has a cylindrical portion extending over a sector slightly greater than 180°, such that the width of an opening of this notch is less than the outer diameter of the rod on which the player is mounted.

4. The player as claimed in claim 1 3, wherein the two elements are made from a rigid material having a certain elasticity from a moldable or injectable plastic.

5. The player as claimed in claim 1 wherein the leg portion has a front face inclined from top to bottom and from the rear to the front.

6. The player as claimed in claim 1 wherein the leg portion has a front face which is vertical but inclined relative to the axis of the rod supporting the player.

* * * * *